US008322703B2

(12) United States Patent
Miwa

(10) Patent No.: US 8,322,703 B2
(45) Date of Patent: Dec. 4, 2012

(54) IMAGE FORMING DEVICE HAVING SHEET CONVEYING DEVICE

(75) Inventor: Atsushi Miwa, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/013,099

(22) Filed: Jan. 25, 2011

(65) Prior Publication Data

US 2011/0233846 A1 Sep. 29, 2011

(30) Foreign Application Priority Data

Mar. 23, 2010 (JP) ..... 2010-066695

(51) Int. Cl.
*B65H 5/00* (2006.01)

(52) U.S. Cl. ..... 271/10.13; 271/114; 271/162

(58) Field of Classification Search ..... 271/10.13, 271/114, 162; 221/151, 153
See application file for complete search history.

(56) References Cited

U.S. PATENT DOCUMENTS

| | | | | |
|---|---|---|---|---|
| 4,799,662 | A * | 1/1989 | Sagara et al. | 271/114 |
| RE35,341 | E * | 10/1996 | Kikuchi et al. | 271/3.14 |
| 6,578,840 | B1 | 6/2003 | Kudo | |
| 7,971,872 | B2 * | 7/2011 | Omura et al. | 271/162 |
| 2005/0073087 | A1 | 4/2005 | Kadowaki et al. | |
| 2010/0007078 | A1 | 1/2010 | Akiyama et al. | |

FOREIGN PATENT DOCUMENTS

| | | |
|---|---|---|
| EP | 1 643 312 | 4/2006 |
| JP | 62-046825 | 2/1987 |
| JP | 04-361930 | 12/1992 |
| JP | 05-147750 | 6/1993 |
| JP | 07-306603 | 11/1995 |
| JP | 10-265084 | 10/1998 |
| JP | 11-222335 | 8/1999 |
| JP | 2004-075334 | 3/2004 |
| JP | 2005-335853 | 12/2005 |
| JP | 2005-343670 | 12/2005 |
| JP | 2008-189400 | 8/2008 |

OTHER PUBLICATIONS

Office Action for corresponding Japanese Patent Application 2010-066695 mailed on Jan. 10, 2012.

European Search Report for corresponding European Patent Application No. 11000584.0 dated May 10, 2012.

Decision of Rejection for corresponding Japanese Patent Application 2010-066695 mailed Mar. 27, 2012.

Examiner's Opinion issued in corresponding Japanese Patent Application 2010-66695 mailed Sep. 25, 2012.

* cited by examiner

*Primary Examiner* — David H Bollinger
(74) *Attorney, Agent, or Firm* — Banner & Witcoff, Ltd.

(57) ABSTRACT

A sheet conveying device includes an accommodating unit, a conveying roller, a driving member, and a clutch mechanism. The accommodating tray has a sheet accommodating unit. The conveying roller is for conveying a sheet. The driving member supplies a drive force to the conveying roller. The clutch mechanism includes a link that moves in mechanical conjunction with the attachment or detachment of the accommodating tray and a movable member that moves in association with the movement of the link. The clutch mechanism selectively connects and disconnects a drive force transmitting path by the movement of the movable member. The clutch mechanism disconnects the drive force transmitting path when the accommodating tray is detached, and the clutch mechanism connects the drive force transmitting path when the accommodating tray is attached.

14 Claims, 10 Drawing Sheets

IMAGE FORMING DEVICE HAVING SHEET CONVEYING DEVICE

CROSS REFERENCE TO RELATED APPLICATION

This application claims priority from Japanese Patent Application No. 2010-066695 filed Mar. 23, 2010. The entire content of this priority application is incorporated herein by reference.

TECHNICAL FIELD

The present invention relates to a sheet conveying device for conveying a sheet accommodated in a sheet accommodating unit and an image forming device having the sheet conveying device.

BACKGROUND

An image forming device disclosed in Japanese patent application publication No. 2005-343670 is provided with a detachable accommodating tray for accommodating sheets and a sheet conveying device that includes a conveying roller for conveying the sheets. A sheet conveying operation of the sheet conveying device is halted by shutting off an electrical power supply to an electric motor upon removing the accommodating tray from the image forming device.

SUMMARY

However, because a rotor of the motor and a gear for transferring a drive force from the motor to the conveying roller have inertia, the sheet conveying operation may not be immediately halted after shutting off of the electrical power supply. That is, because the electric power supply to the motor is shut off while a drive force transmitting path from the motor to the conveying roller is maintained connected, inertia in the drive force transmitting path and the motor is maintained and delays a halt of the conveying roller.

In view of the foregoing, it is an object of the invention to provide an image forming device in which a sheet conveying operation is halted by a method different from the above-described method upon removing a sheet tray from a main body of the image forming device.

In order to attain the above and other objects, the present invention provides a sheet conveying device. The sheet conveying device includes a main body, an accommodating unit, a conveying roller, a driving member, and a clutch mechanism. The accommodating tray has a sheet accommodating unit and is detachably mounted on the main body. The conveying roller is provided in the main body and is for conveying a sheet accommodated in the sheet accommodating unit. The driving member is provided in the main body and supplies a drive force to the conveying roller. The clutch mechanism disconnects a drive force transmitting path when the accommodating tray is detached from the main body and connects the drive force transmitting path when the accommodating tray is attached to the main body. The clutch mechanism includes a link that moves in mechanical conjunction with the attachment and detachment of the accommodating tray to and from the main body and a movable member that moves in association with the movement of the link so as to selectively connect and disconnect the drive force transmitting path. The drive force is transmitted through the drive force transmitting path from the driving member to the conveying roller.

According to another aspect, the present invention provides an image forming device. The image forming device includes an image forming unit and the above-described sheet conveying device. The image forming unit forms an image on a sheet.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
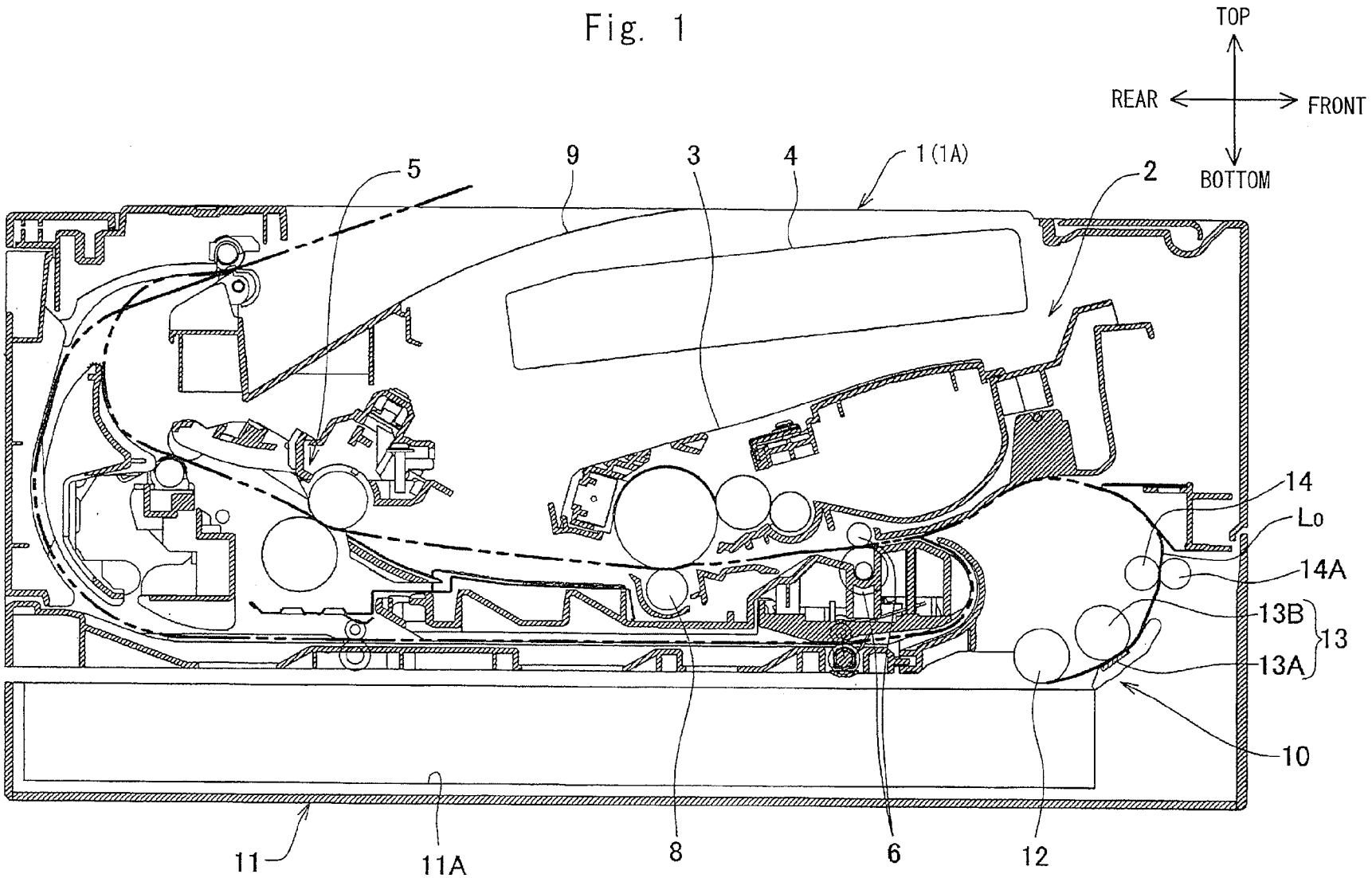
FIG. 1 is a center cross-sectional view of an image forming device according to a preferred embodiment of the present invention.

An image forming device 1 according to an embodiment of the invention will be described while referring to the accompanying drawings wherein like parts and components are designated by the same reference numerals to avoid duplicating description.

The terms "upward", "downward", "upper", "lower", "above", "below", "beneath", "right", "left", "front", "rear" and the like will be used throughout the description assuming that the image forming device 1 is disposed in an orientation in which it is intended to be used.

The image forming device 1 is a laser printer and, as shown in FIG. 1, includes a main body 1A, an image forming unit 2, and a sheet conveying device 10. The main body 1A is an outer casing accommodating the image forming unit 2, and the image forming unit 2 is for forming (printing) an image on paper sheets or OHP sheets (hereinafter referred to as "sheets"). The sheet conveying device 10 performs an operation to convey sheets toward the image forming unit 2 (hereinafter referred to as a "sheet conveying operation").

The image forming unit 2 is an electrophotographic type image forming unit including a process cartridge 3, an exposure unit 4, a fixing unit 5, a pair of registration rollers 6, and a transfer roller 8. Sheets are conveyed from the sheet conveying device 10 to the pair of registration rollers 6, and further to the image forming unit 2 after a skew in the sheets is corrected by the pair of registration rollers 6.

The transfer roller 8 is located immediately below the process cartridge 3 for transferring a toner image onto the sheet. The fixing unit 5 functions to thermally fix the toner image transferred to the sheet. The sheet discharged from the fixing unit 5 is conveyed upward to a discharge tray 9 provided on an upper surface of the main body 1A.

The sheet conveying device 10 includes a sheet tray 11 having a sheet accommodating unit 11A for accommodating stacked sheets, a pickup roller 12 that contacts an uppermost one of the sheets in the sheet tray 11 and conveys the sheets toward the image forming unit 2, a separation mechanism 13, a conveying roller 14 for feeding the sheet while rotating about a drive shaft 14B, and a press roller 14A for pressing the sheet against the conveying roller 14.

Figure 2:
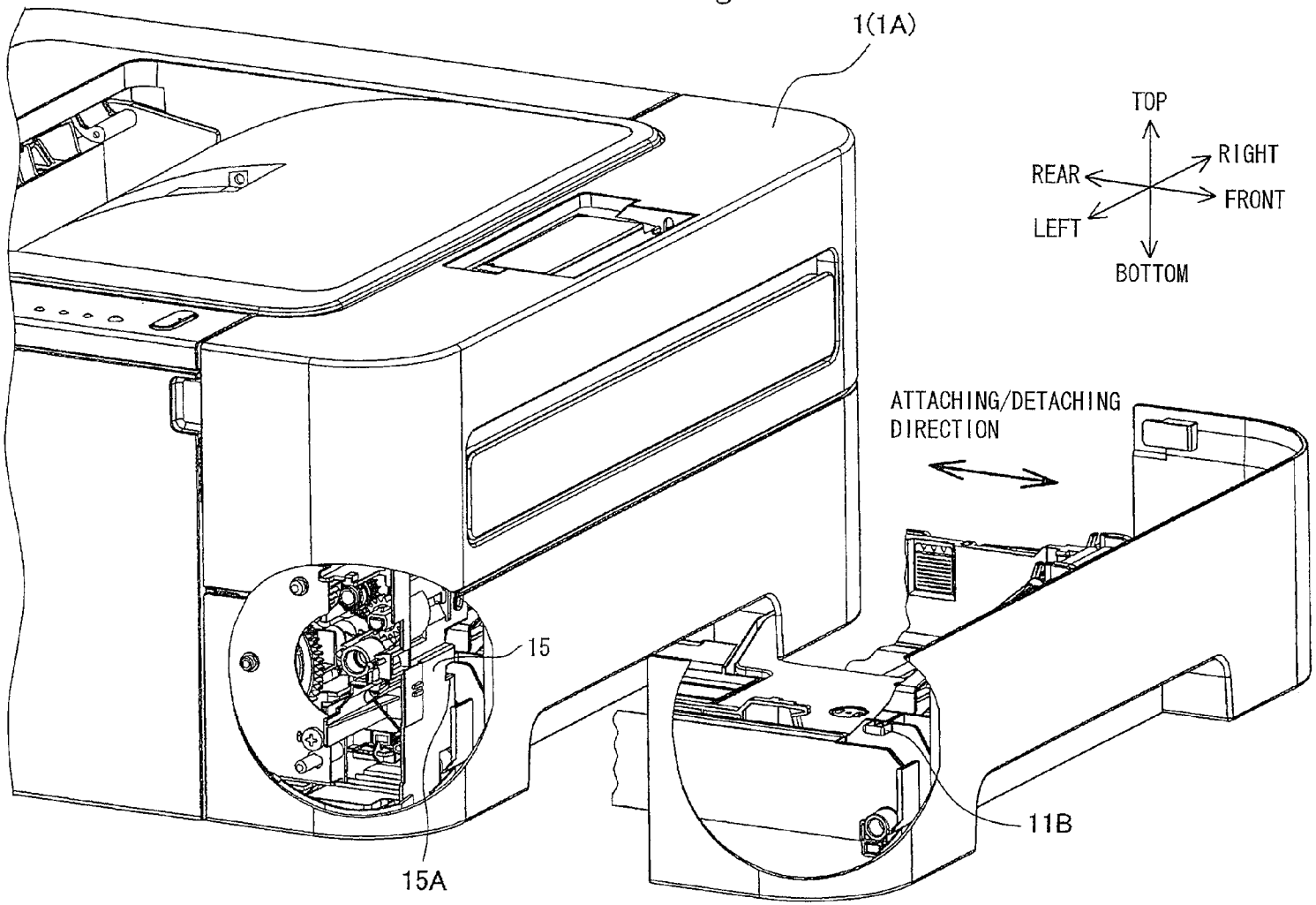
FIG. 2 is a perspective view of the image forming device, showing attachment and detachment of a sheet tray.

The sheet tray 11 is mounted in a bottom section of the main body 1A as shown in FIG. 2, so as to be attached to and detached from the main body 1A in a front-to-rear direction, i.e., a direction in which the sheet is conveyed from the sheet accommodating unit 11A.

Figure 4:
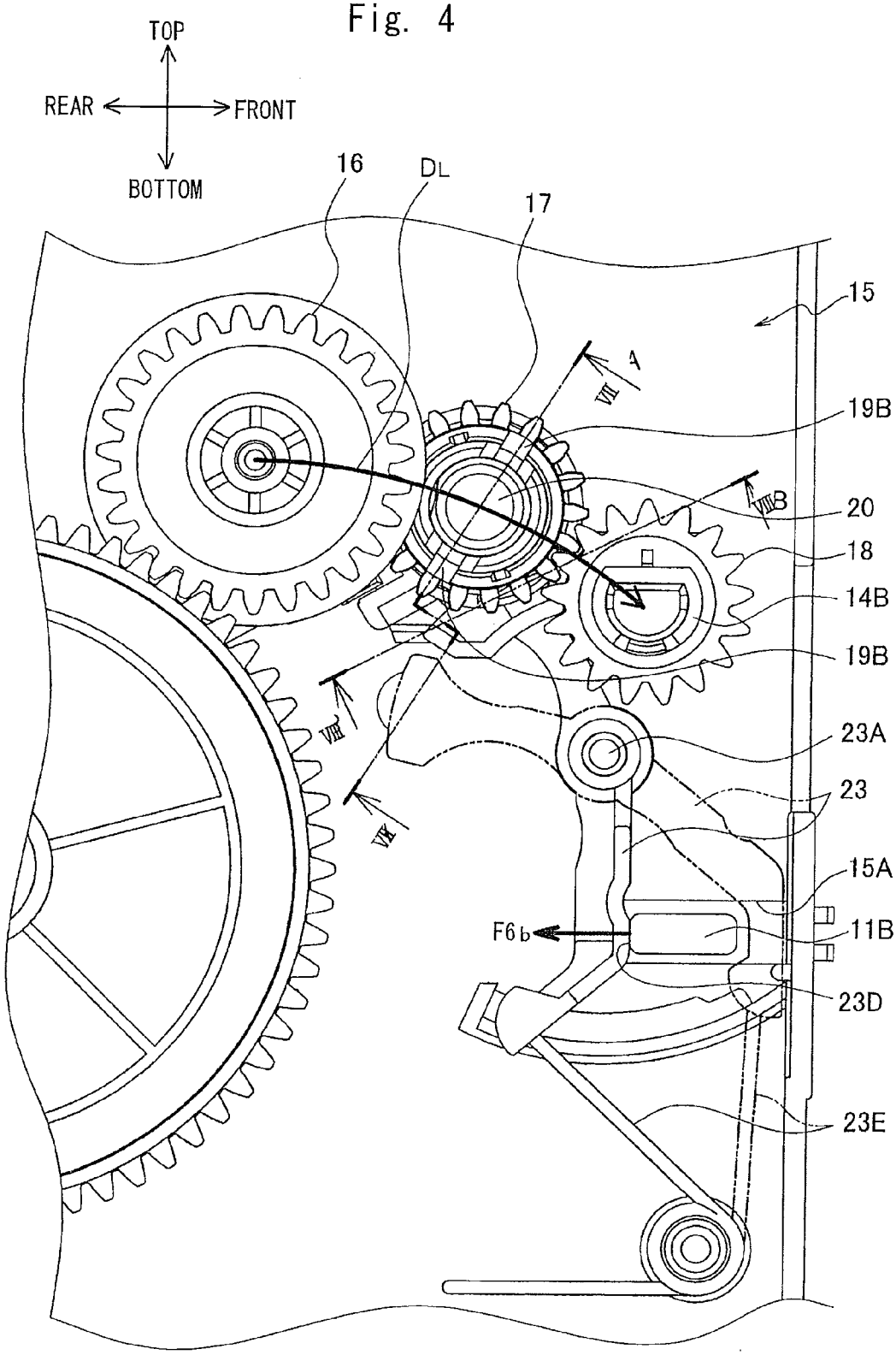
FIG. 4 is a front view of the gear train and a link as viewed from an arrow A of FIG. 3.

The main body 1A is provided with a frame 15 (see FIG. 4). The frame 15 has plate-like support members extending in a vertical direction and located to sandwich the image forming unit 2 and the sheet tray 11 therebetween in a right-to-left direction, i.e., a direction perpendicular to the attaching/detaching direction of the sheet tray 11 and a thickness direction of the sheet.

The separation mechanism 13 includes a separation pad 13A and a separation roller 13B. The separation roller 13B generates a friction by contacting one side of sheets conveyed by the pickup roller 12, and the separation roller 13B generates a conveying force by contacting the other side of the sheets. As a result, one of the sheets is separated and fed toward the image forming unit 2.

The pickup roller 12, the separation roller 13B, and the conveying roller 14 are assembled in the main body 1A. The separation pad 13A and the press roller 14A are assembled in the sheet tray 11.

When the sheet tray 11 is removed from the main body 1A, the conveying roller 14 and a part of a sheet feeding path L0 through which the sheet is fed by the conveying roller 14 is exposed outside the main body 1A.

The press roller 14A functions to remove a paper dust generated at the separation pad 13A while pressing the sheet toward the conveying roller 14 from the same side of the sheet as the separation pad 13A.

Figure 3:
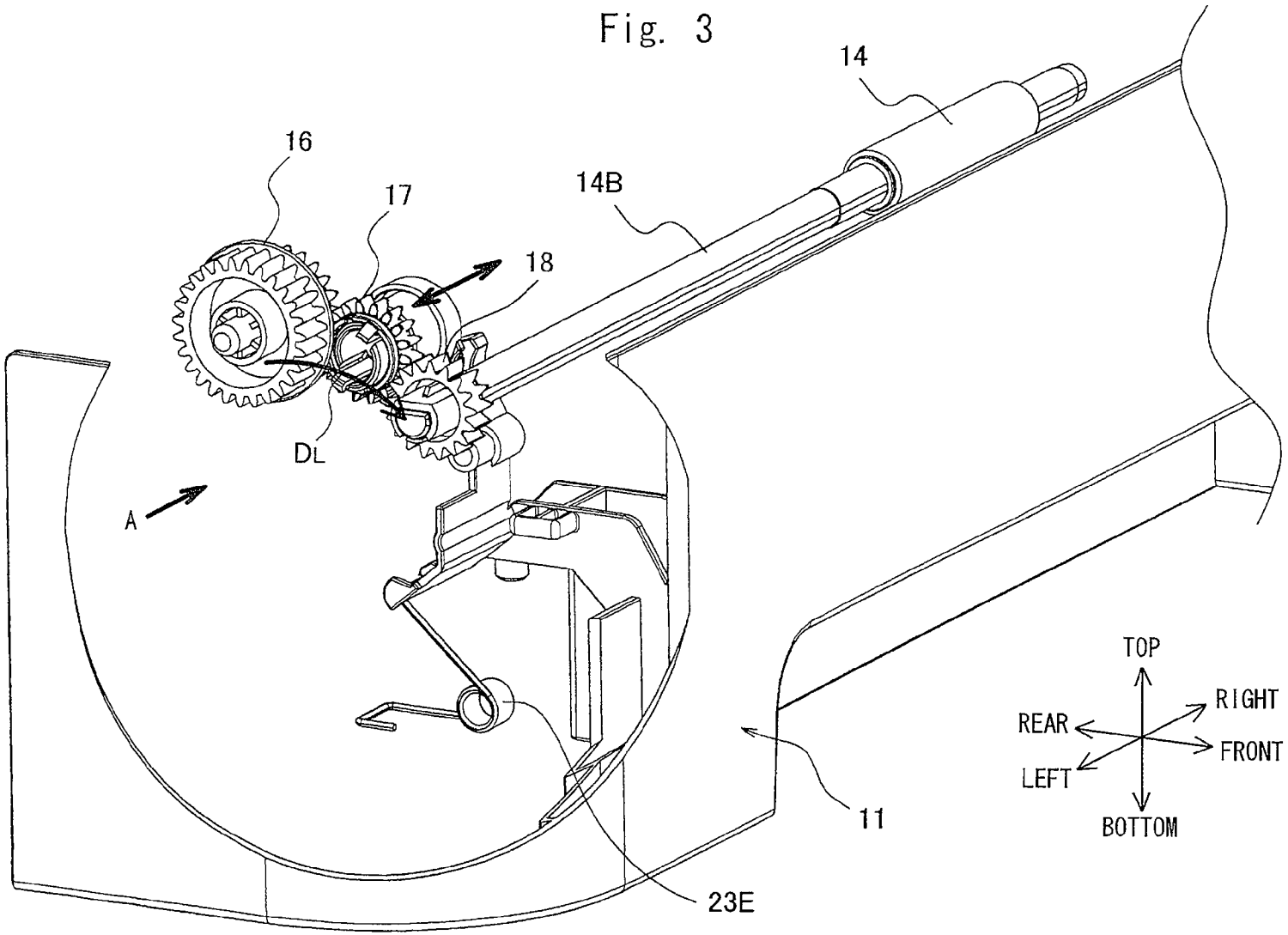
FIG. 3 is a perspective view showing positional relationship between the sheet tray and a gear train.
Figure 5:
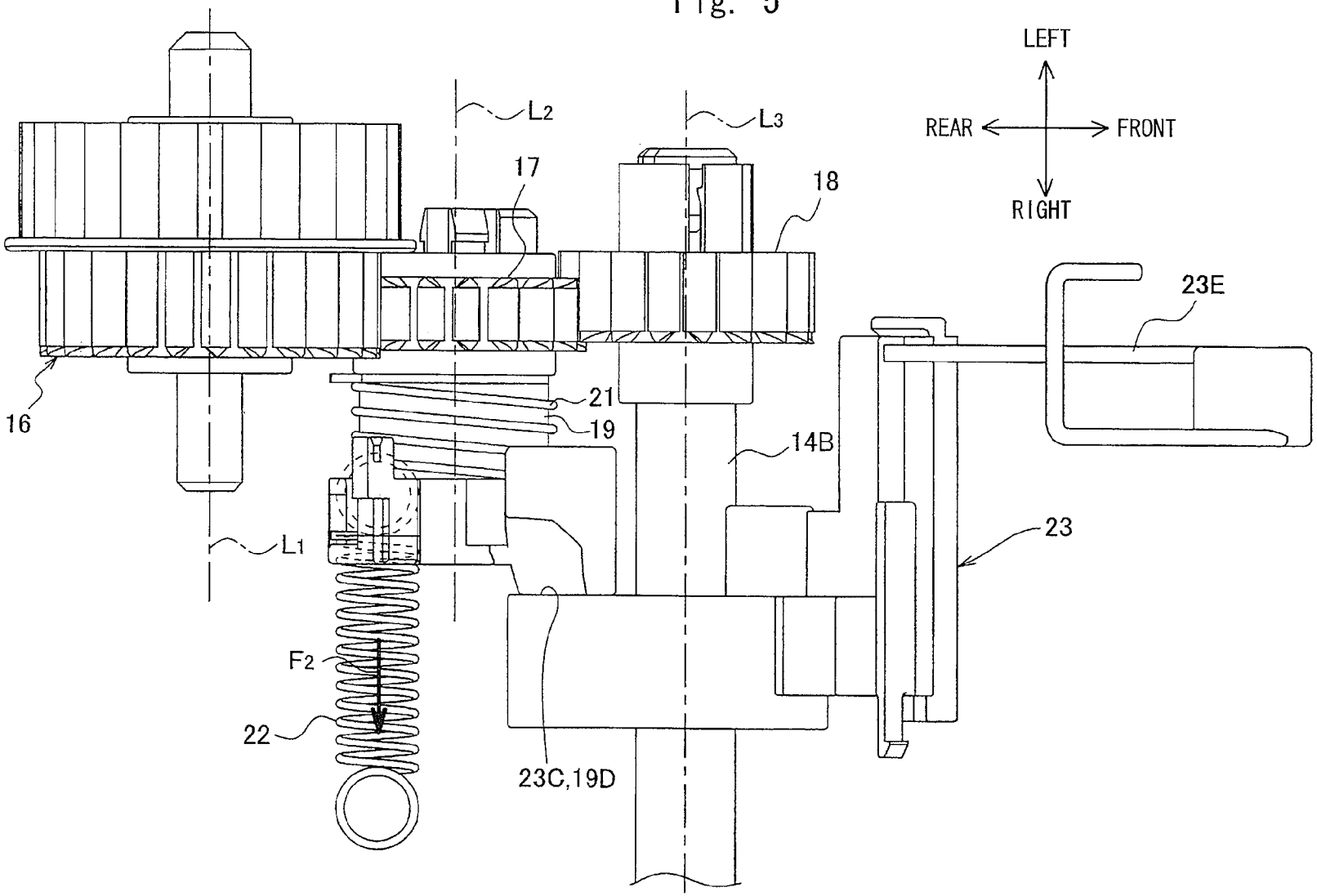
FIG. 5 is a top view illustrating an intermediate gear engaged with a drive gear and a follower gear.

As shown in FIG. 3, the conveying roller 14 is rotated by a drive force transmitted from a motor (not shown) via a drive line DL formed by a gear train including a drive gear 16, an intermediate gear 17, and a follower gear 18. As shown in FIG. 5, each of the gears 16, 17, 18 rotates about corresponding one of rotational axis lines L1, L2, L3 extending parallel with each other in the right-to-left direction.

The drive gear 16 receives the drive force from the motor. The follower gear 18 is disposed at one end of the drive shaft 14B to rotate integrally with the conveying roller 14. The intermediate gear 17 transfers the drive force from the drive gear 16 to the follower gear 18.

Figure 6:
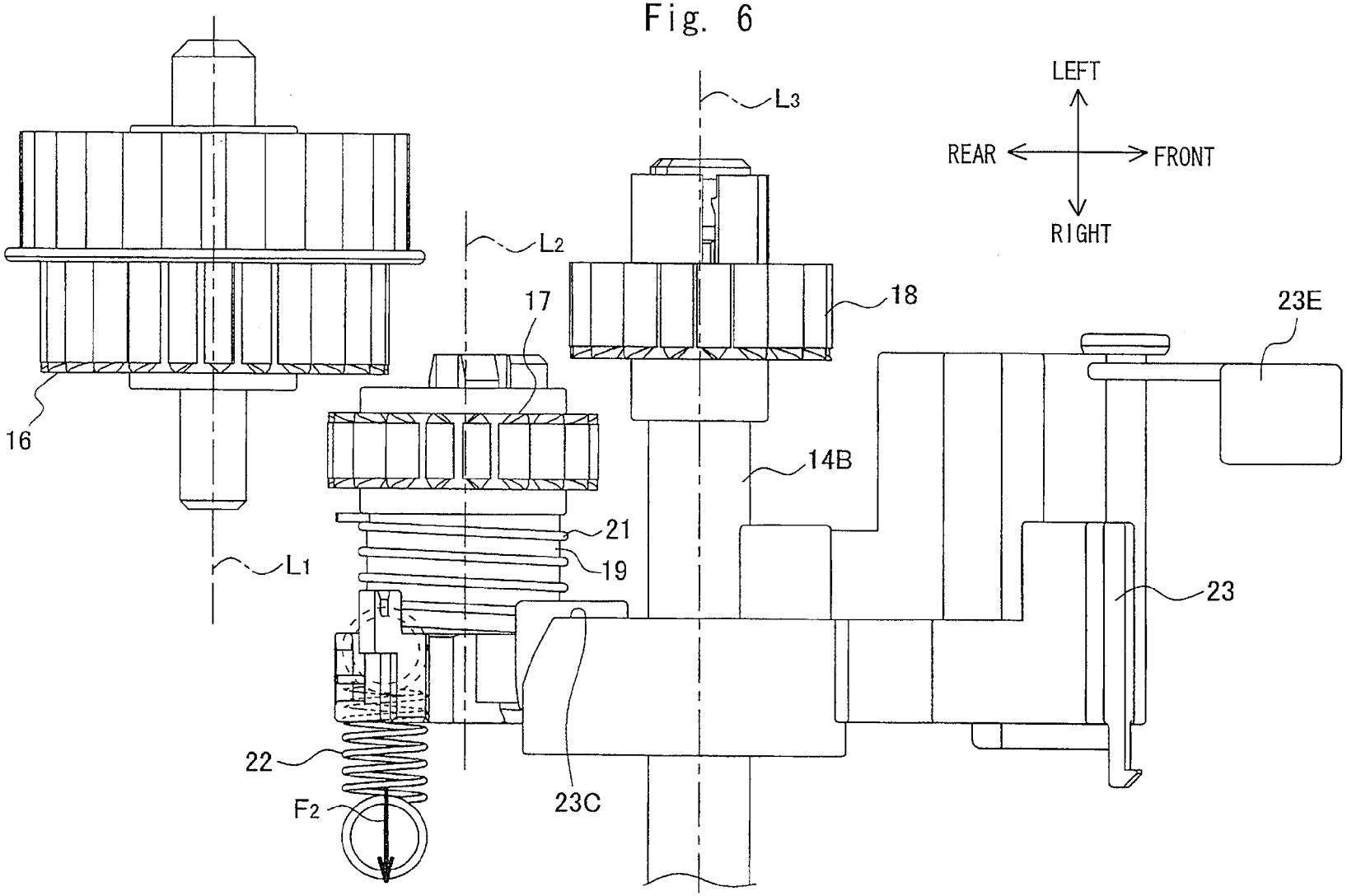
FIG. 6 is a top view illustrating the intermediate gear being separate from the drive gear and the follower gear.

While the drive gear 16 and the follower gear 18 are rotatably supported on the frame 15 at fixed positions as shown in FIG. 4, the intermediate gear 17 is supported on the frame 15 so as to be movable in a direction parallel to the rotational axis line L2 (hereinafter referred to as an axial direction L2) as shown in FIGS. 5 and 6.

Thus, when the intermediate gear 17 engages with the drive gear 16 and the follower gear 18 as shown in FIG. 5, the drive line DL is in a connecting state. When, on the other hand, the intermediate gear 17 is separate from the drive gear 16 and the follower gear 18 as shown in FIG. 6, the drive line DL is in a disconnecting state.

Figure 7:
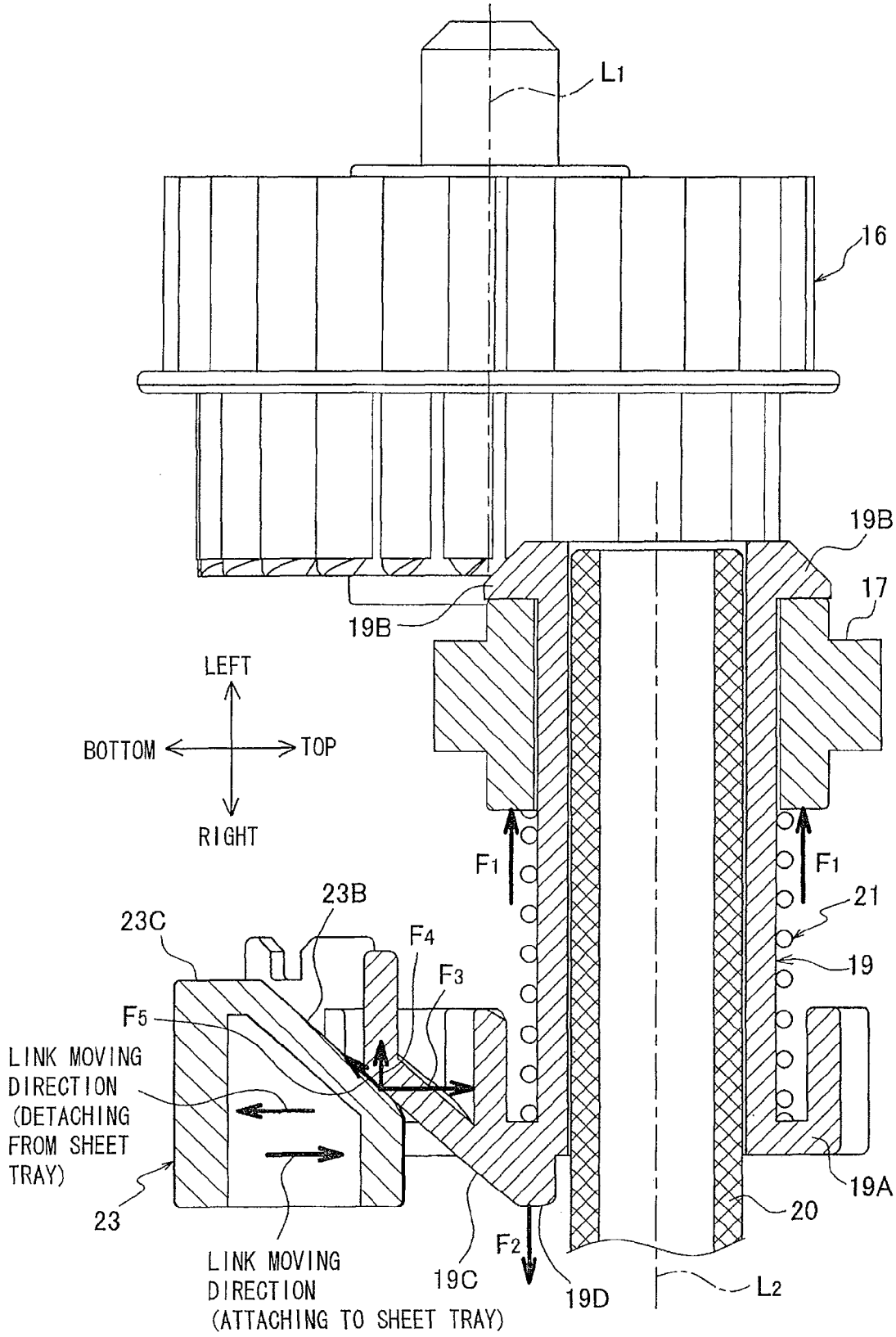
FIG. 7 is a cross-sectional view taken along a line VII-VII of FIG. 4 showing the intermediate gear being separate from the drive gear.

Specifically, as shown in FIG. 7, the intermediate gear 17 is rotatably supported by a cylindrical support member 19. The support member 19 is formed with an inner through hole into which a cylindrical support shaft 20 formed integrally with the frame 15 and protruding in the axial direction L2 is inserted. Thus, the support member 19 is movable in the axial direction L2 with respect to the support shaft 20, and the intermediate gear 17 is rotatable and movable in the axial direction L2 relative to the support member 19.

That is, the intermediate gear 17 is movable in the axial direction L2 relative to the drive gear 16 and the follower gear 18 while being rotatably supported by the frame 15 via the support member 19 and the support shaft 20.

As shown in FIG. 7, a first spring 21 is provided on the support member 19. The first spring 21 is a coil spring, and the support member 19 is inserted in an inner hole of the first spring 21. The first spring 21 is located between a flange portion 19A formed at one end of the support member 19 and the intermediate gear 17.

Figure 8:
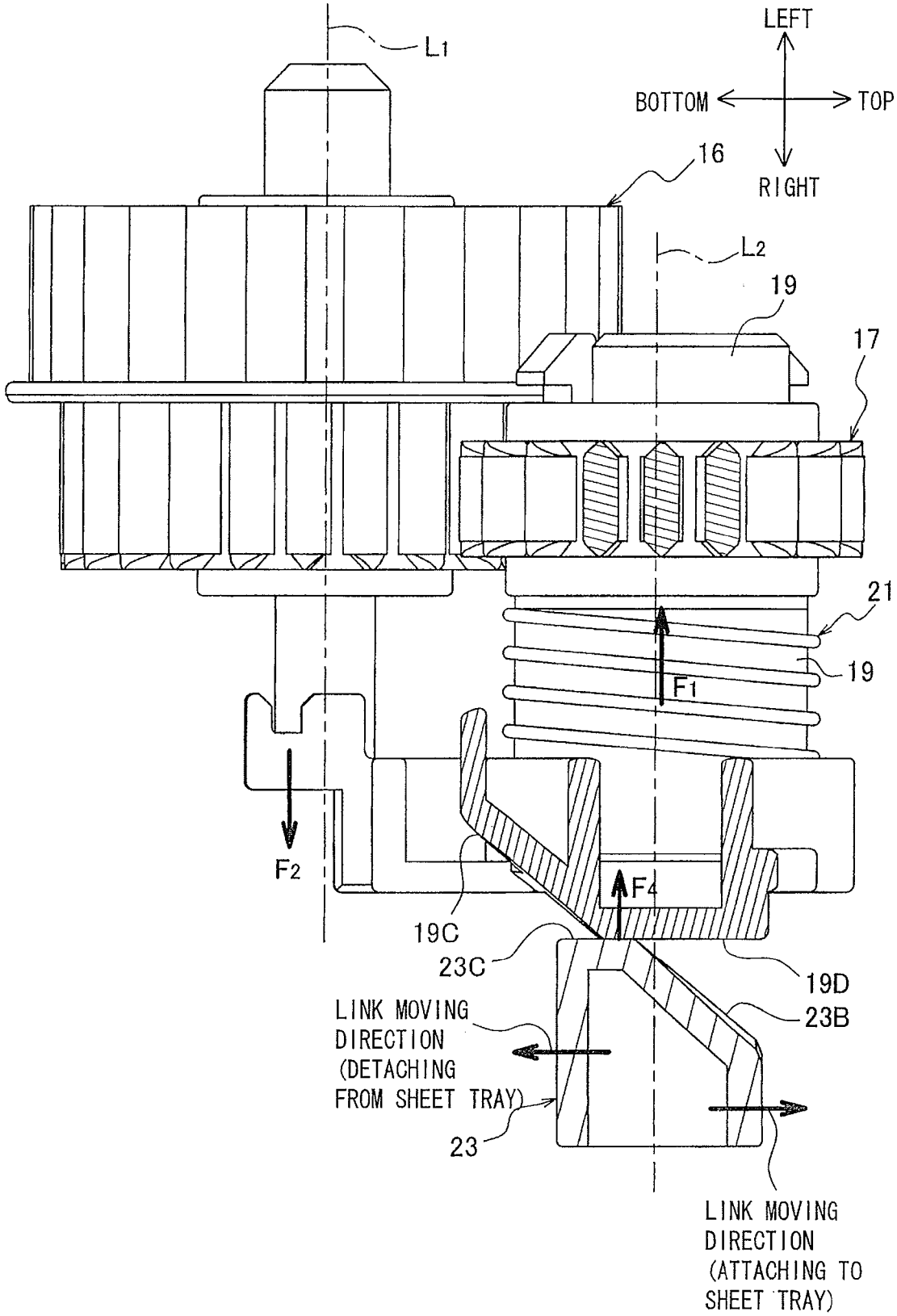
FIG. 8 is a cross-sectional view taken along a line VIII-VIII of FIG. 4 showing the intermediate gear being engaged with the drive gear.

As shown in FIG. 8, the first spring 21 generates an elastic force F1 that constantly urges the intermediate gear 17 leftward, i.e., in a direction from a position where the intermediate gear 17 is separate from the drive gear 16 and the follower gear 18 as shown in FIG. 6 toward a position where the intermediate gear 17 engages with the drive gear 16 and the follower gear 18 as shown in FIG. 5 (hereinafter referred to as an engaging direction).

The support member 19 is formed with a pair of stopper portions 19B on the other end for preventing the intermediate gear 17 from falling out from the support member 19. A user can mount the intermediate gear 17 on the support member 19 by elastically moving the pair of stopper portions 19B so as to near the pair of stopper portions 19B with each other. The stopper portion 19B is made of resin integrally with the support member 19.

Note that the intermediate gear 17 needs to be mounted on the support member 19 before the support shaft 20 is inserted into the support member 19. Specifically, after the first spring 21 is mounted on the support member 19, the intermediate gear 17 is mounted on the support member 19, and then the support member 19 is mounted on the support shaft 20.

As shown in FIG. 5, the flange portion 19A is connected to a second spring 22. The second spring 22 generates an elastic force F2 that constantly urges the support member 19 rightward, i.e., in a direction from a position where the intermediate gear 17 engages with the drive gear 16 and the follower gear 18 as shown in FIG. 5 toward a position where the intermediate gear 17 is separate from the drive gear 16 and the follower gear 18 as shown in FIG. 6 (hereinafter referred to as a separating direction).

The second spring 22 is a coil spring and has one end connected to the flange portion 19A and the other end connected to the frame 15 of the main body 1A.

As shown in FIG. 4, the frame 15 is provided with a link 23. The link 23 is bent to an L-shape and pivotally movable about a link shaft 23A inserted through a bending portion of the link 23. The link shaft 23A is in a cylindrical shape and protrudes from the frame 15 parallel to the axial direction L2. The link 23 is mechanically interlocked with the sheet tray 11 so as to move in association with attachment/detachment of the sheet tray 11.

As shown in FIGS. 7 and 8, the link 23 has at its longitudinal end a leading surface 23B for leading the support member 19 in the engaging direction by slidably contacting with a cam surface 19C of the support member 19 and a maintaining surface 23C for maintaining the drive line DL in the connecting state by contacting with a press surface 19D of the support member 19.

The leading surface 23B and the cam surface 19C are slanting with respect to the axial direction L2 so as to move the support member 19 in the axial direction L2 in mechanical conjunction with the pivotal movement of the link 23.

Specifically, as shown in FIG. 7, the leading surface 23B and the cam surface 19C are formed slanting so as to generate a force F4 that presses the support member 19 in the engaging direction opposite from the direction (the separating direction) of the elastic force F2 constantly pressing the support member 19 in the separating direction. A force F3 is generated by pressing the leading surface 23B to the cam surface 19C. The force F4 is a component of the force F3 in the axial direction L2.

Thus, when the leading surface 23B moves toward the support shaft 20, the force F4 in the engaging direction (hereinafter referred to as a "moving force F4") and a force F5 that is a component of the moving force F4 in a direction parallel to the cam surface 19C are exerted on the support member 19 through the cam surface 19C. As a result, the cam surface 19C moves along the leading surface 23B toward the maintaining surface 23C, and the support member 19 moves in the engaging direction.

The maintaining surface 23C and the press surface 19D are plane surfaces extending perpendicular to the axial direction L2. The maintaining surface 23C is formed continuous with the leading surface 23B, and the press surface 19D is formed continuous with the cam surface 19C.

When the cam surface 19C moves along the leading surface 23B toward the maintaining surface 23C, the maintaining surface 23C eventually comes into contact with the press surface 19D as shown in FIG. 8, and the force F5 is disappeared. As a result, the elastic force F2 is balanced with the moving force F4, and the support member 19 is maintained at an engagable position where the intermediate gear 17 is engagable with the drive gear 16 and the follower gear 18.

As shown in FIG. 4, the link 23 also has a contacting surface 23D near a lower end thereof, i.e., at a position on the opposite side of the link shaft 23A from the leading surface 23B. The contacting surface 23D is for contacting with a press portion 11B of the sheet tray 11. When the sheet tray 11 is attached to the main body 1A, the press portion 11B keeps in contact with the contacting surface 23D and exerts on the link 23 a maintaining force F6 for maintaining the maintaining surface 23C in contact with the press surface 19D.

Upon attaching the sheet tray 11 to the main body 1A, the maintaining surface 23C contacts the press surface 19D, and the support member 19 is maintained at the engagable position. Thus, the intermediate gear 17 is maintained at a connecting position where the drive line DL is in the connecting state.

The sheet tray 11 is located between the pair of frames 15, and the link 23 is located opposite to the sheet tray 11 with respect to the frame 15 as shown in FIGS. 2 and 4. One of the frames 15 is formed with a groove 15A through which the press portion 11B is inserted. The press portion 11B protrudes leftward from the sheet tray 11.

More specifically, the groove 15A is formed on the right surface of one of the frame 15 on the left side so as to extend and penetrate through the frame 15 in the attaching/detaching direction of the sheet tray 11. Thus, the frame 15 does not interfere with the press portion 11B when attaching the sheet tray 11.

As shown in FIG. 4, the lower end of the link 23 is attached with a recovering spring 23E for constantly exerting an elastic force opposed to the maintaining force F6 on the link 23. Upon detaching the sheet tray 11 from the main body 1A, the maintaining force F6 is disappeared, and the elastic force of the recovering spring 23E moves the link 23 from a position indicated by solid line in FIG. 4 to a position indicated by two-dotted line in FIG. 4.

Figure 10B:
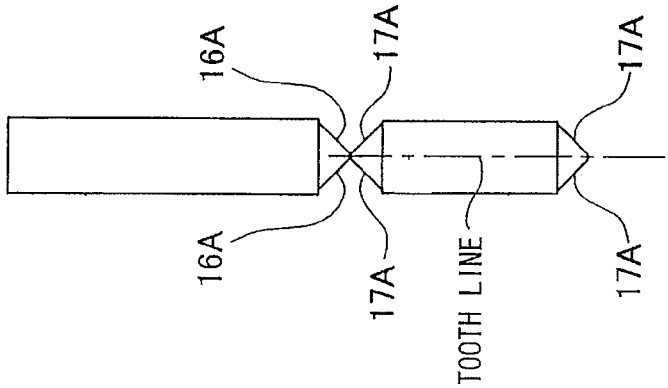
FIG. 10B is an explanatory diagram showing a sloping guide surface of the intermediate gear and a sloping guide surface of the drive gear.
Figure 10A:
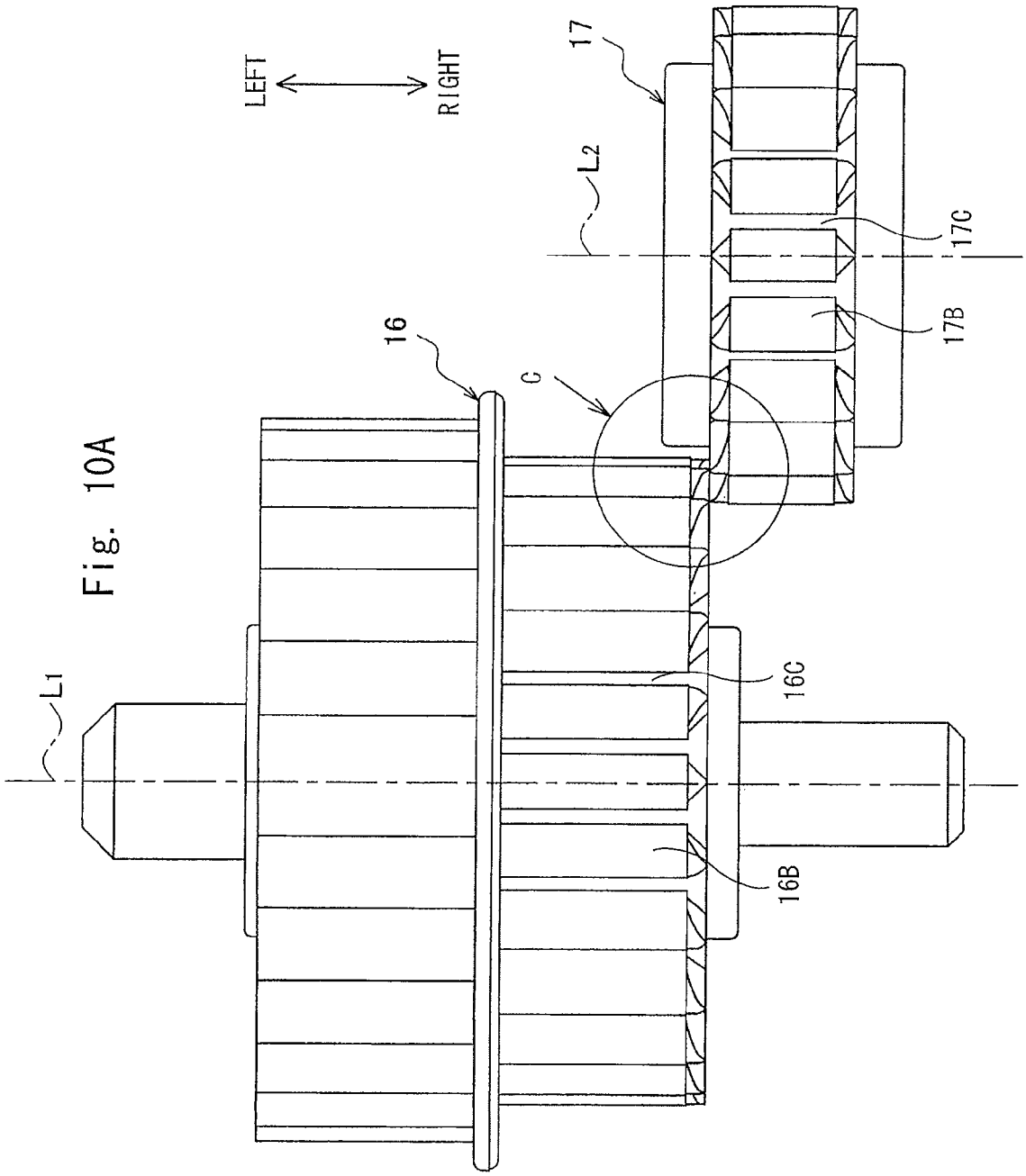
FIG. 10A is an enlarged top view of the intermediate gear colliding with the drive gear.

As shown in FIGS. 10A and 10B, the intermediate gear 17 has a plurality of teeth, and each tooth has a sloping guide surface 17A at its left end that collides with a tooth of the drive gear 16 as shown in FIG. 10B when the intermediate gear 17 moves in the engaging direction. The sloping guide surface 17A slants with respect to the moving direction of the intermediate gear 17 (engaging direction).

That is, because the intermediate gear 17 and the drive gear 16 are spur gears and because the engaging direction is parallel to the axial direction L2, i.e., a tooth line, the sloping guide surface 17A is formed on at least the left end of the tooth.

In the embodiment, the sloping guide surfaces 17A are formed on both longitudinal ends of each tooth of the intermediate gear 17. Each sloping guide surface 17A is symmetrically slanting with respect to the tooth line. Thus, the intermediate gear 17 can be mounted on the support member 19 from either direction, thereby enhancing workability.

Similarly to the intermediate gear 17, each tooth of the drive gear 16 and the follower gear 18 has a sloping guide surface 16A or 18A (FIG. 9) slanting with respect to the tooth line at its right end that collides with the intermediate gear 17 when the intermediate gear 17 moves in the engaging direction.

In the embodiment, when the sheet tray 11 is in attachment with the main body 1A, the press portion 11B is maintained in contact with the contacting surface 23D, and the maintaining surface 23C is maintained in contact with the press surface 19D (FIG. 8) as described above. As a result, the support member 19 is maintained at the engagable position (FIG. 5), and the drive line DL is in the connecting state.

At this time, the first spring 21 exerts on the intermediate gear 17 the elastic force F1 in the engaging direction so as to maintain the engagement with the drive gear 16 and the follower gear 18. Thus, if the drive gear 16 rotates in this condition, a drive force is transmitted from the drive gear 16 to the follower gear 18 via the intermediate gear 17, and the conveying roller 14 rotates.

On the other hand, when the sheet tray 11 is detached from the main body 1A, the maintaining force F6 pressing the link 23 is disappeared, and the elastic force of the recovering spring 23E moves the link 23 from the position indicated by solid line in FIG. 4 to the position indicated by two-dotted line in FIG. 4. As a result, the maintaining surface 23C moves toward the cam surface 19C away from the support shaft 20 as shown in FIG. 7, and the cam surface 19C contacts the leading surface 23B.

At this time, the recovering spring 23E exerts on the link 23 the elastic force in a direction to separate the leading surface 23B and the maintaining surface 23C from the support shaft 20, and the second spring 22 exerts on the support member 19 the elastic force F2 in the separating direction. As a result, as shown in FIGS. 6 and 7, the intermediate gear 17 moves together with the support member 19 in the separating direction while being in contact with the stopper portion 19B, and the intermediate gear 17 disengages from the drive gear 16 and the follower gear 18.

When the sheet tray 11 is attached to the main body 1A, the press portion 11B exerts the maintaining force F6 on the contacting surface 23D, so the link 23 is moved from the position indicated by two-dotted line in FIG. 4 to the position indicated by solid line in FIG. 4. As a result, as shown in FIG. 7, the leading surface 23B moves toward the support shaft 20, and the cam surface 19C moves along the leading surface 23B toward the maintaining surface 23C, and the support member 19 moves in the engaging direction.

Figure 9:
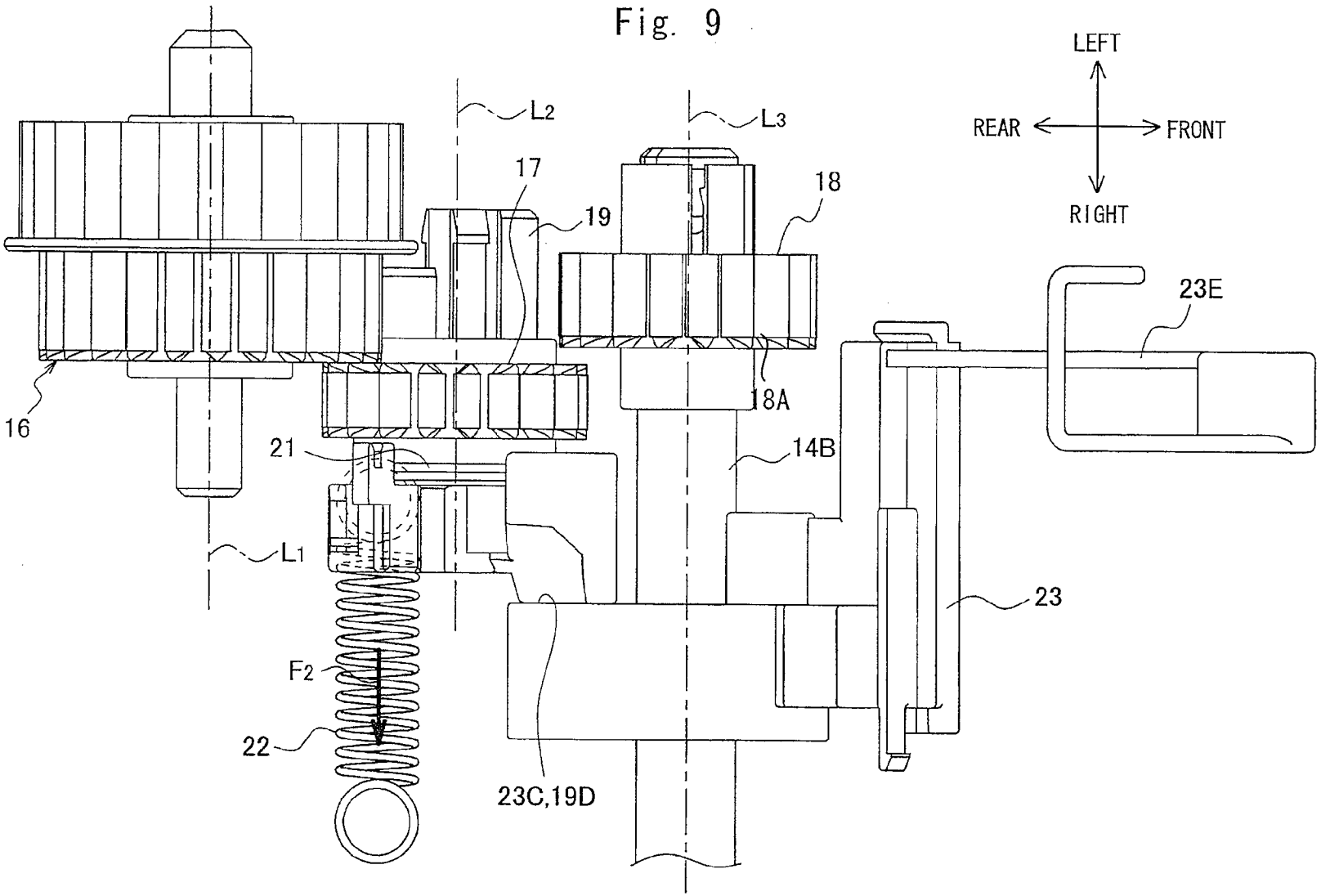
FIG. 9 is a top view illustrating the intermediate gear colliding with the drive gear.

As shown in FIG. 9, if the intermediate gear 17 fails to engage with the drive gear 16 at this time, only the support member 19 moves in the engaging direction while the intermediate gear 17 compresses the first spring 21 and is remained at the same position.

Note that, failure of the gear engagement means that, as shown in FIGS. 10A and 10B, a convex part 17B of the intermediate gear 17 does not engage with a recess part 16C of the drive gear 16, but colloids with a convex part 16B of the drive gear 16.

When the drive gear 16 out of engagement with the intermediate gear 17 rotates while the support member 19 is at the engagable position, the drive gear 16 moves relative to the intermediate gear 17, and when the convex part 17B comes into alignment with the recess part 16C, the elastic force F1 of first spring 21 moves the intermediate gear 17 in the engaging direction. Thus, even if the intermediate gear 17 fails to engage with the drive gear 16, the intermediate gear 17 can engage with the drive gear 16 and the follower gear 18 after the drive gear 16 slightly rotates.

In the embodiment, the link 23 is pivotally moved in mechanical conjunction with the detachment of the sheet tray 11 from the main body 1A. As a result, the intermediate gear 17 moves in the separating direction to bring the drive line DL into the disconnecting state, thereby immediately halting the sheet conveying operation.

In the above-mentioned conventional device, because an electric power supply to the motor is shut off while a drive force transmitting path from the motor to the conveying roller is maintained connected, inertia in the drive force transmitting path and the motor is maintained and delays a halt of the conveying roller.

On the other hand, in the embodiment, because the drive line DL is disconnected by the movement of the intermediate gear 17, only inertia in a section of the disconnected drive line DL nearest the conveying roller 14 affects a halt of the conveying roller 14, and inertia in remaining section of the disconnected drive line DL nearest the drive gear 16 (motor) does not affect the halt of the conveying roller 14. Further, in the embodiment, the drive line DL is connected and disconnected by the movement of the intermediate gear 17 that directly transmits the drive force from the drive gear 16 to the drive shaft 14B of the conveying roller 14.

Therefore, the conveying roller 14 of the embodiment can be halted quicker than that of the conventional device, and can be easily rotated in a reverse direction, enabling the user to remove jammed sheets easily.

In the embodiment, the link 23 maintains the intermediate gear 17 at the connecting position by being in contact with the press portion 11B of the sheet tray 11, and the intermediate gear 17 and the link 23 are mounted on the main body 1A.

With this configuration, there is less danger of damage to movable components such as the intermediate gear 17 and the link 23 than if the movable components are mounted on the sheet tray 11.

That is, if the movable components are detached together with the sheet tray 11 from the main body 1A, the movable components may be damaged by bumping against a desk or a shelf. However, in the embodiment, since the movable components are mounted on the main body 1A, the movable components are prevented from being damaged.

In the embodiment, the drive line DL is switched between the connecting state and the disconnecting state by a linear movement of the intermediate gear 17, and this configuration functions as a clutch mechanism. With this configuration, movable region of the intermediate gear 17 can be minimized compared with a configuration in which the intermediate gear 17 is moved in pendulum motion, i.e., one end of the support shaft 20 is pivotally movably supported by the frame 15 and the drive line DL is switched between the connecting state and the disconnecting state by a pivotal movement of the support shaft 20. Thus, a size of the clutch mechanism can be minimized.

In the embodiment, the sheet conveying device 10 includes the support member 19 which rotatably supports the intermediate gear 17 and which is movable relative to the other gears 16 and 18, and also includes the first spring 21 for exerting on the intermediate gear 17 the elastic force F1 in the engaging direction.

With this configuration, even if the intermediate gear 17 collides with the drive gear 16 or the follower gear 18 and fails to engage therewith while moving toward the drive gear 16 and the follower gear 18, the intermediate gear 17 can engage with the drive gear 16 after gear 16 or 18 slightly rotates because the elastic force F1 is exerted on the intermediate gear 17 in the engaging direction. Thus, the intermediate gear 17 can reliably engage with the drive gear 16 and the follower gear 18.

In the embodiment, the link 23 has the leading surface 23B for leading the support member 19 from the engagable position to the position where the drive line DL is in the disconnecting state by sliding on the cam surface 19C of the support member 19 and the maintaining surface 23C for maintaining the support member 19 at the engagable position.

Thus, the maintaining force F6 for maintaining the sheet tray 11 on the main body 1A can also maintain the support member 19 at the engagable position.

In the embodiment, the sloping guide surface 17A slanting against the moving direction of the intermediate gear 17 is formed at a position where the tooth of the intermediate gear 17 collides with the tooth of the drive gear 16 or the follower gear 18 when the intermediate gear 17 moves from the position where the intermediate gear 17 is separate from the drive gear 16 toward the connecting position.

With this configuration, even if the convex part 17B of the intermediate gear 17 collides with the convex part 16B of the drive gear 16, the sloping guide surface 17A leads the convex part 17B toward the recess part 16C. Thus, the intermediate gear 17 can reliably engage with the drive gear 16.

While the invention has been described in detail with reference to the embodiment thereof, it would be apparent to those skilled in the art that various changes and modifications may be made therein without departing from the spirit of the invention.

In the above-mentioned embodiment, the intermediate gear 17 moves linearly along the axial direction L2. However, the present invention is not limited to this configuration. For example, the intermediate gear 17 may be configured to move in pendulum motion to switch the drive line DL between the connecting state and the disconnecting state.

Further, even if the intermediate gear 17 is configured to move in pendulum motion, the sloping guide surface 17A is preferably formed on each tooth of the intermediate gear 17. In this case, a radial outward end of the tooth of the intermediate gear 17 corresponds to a portion that collides with the tooth of the drive gear 16 when the intermediate gear 17 moves toward the drive gear 16, and the moving direction of the intermediate gear 17 corresponds to a direction in which the intermediate gear 17 pivotally moves.

In the above-mentioned embodiment, the clutch mechanism connects or disconnects the drive line DL by the movement of at least one of the gears in the drive line DL. However, the present invention is not limited to this configuration. For example, the clutch mechanism may be a friction clutch, a clutch mechanism in which a pair of disc shaped face gears is in confrontation with each other, or a clutch mechanism in which the drive line DL is connected or disconnected by adjusting a tension of a belt.

Although the sheet conveying device of the embodiment is mounted in the image forming device (laser printer), the present invention is not limited to this configuration.

What is claimed is:

1. A sheet conveying device comprising:

a main body;

an accommodating tray having a sheet accommodating unit, wherein the accommodating tray is detachably mountable on the main body;

a conveying roller provided in the main body, the conveying roller configured to convey a sheet accommodated in the sheet accommodating unit;

a driving member provided in the main body and configured to supply a drive force to the conveying roller; and a clutch mechanism configured to disconnect a drive force transmitting path when the accommodating tray is detached from the main body and to connect the drive force transmitting path when the accommodating tray is attached to the main body, wherein the clutch mechanism includes;

a link configured to move in mechanical conjunction with the attachment and detachment of the accommodating tray to and from the main body, a movable member configurd to move in association with movement of the link so as to selectively connect and disconnect the drive force transmitting path, and a support member configured to support the movable member and having a first spring, the first spring configured to urge the movable member in a first direction, wherein the sheet conveying device further comprises a second spring configured to urge the support member in a second direction opposite to the first direction, wherein the support member, the first spring and the second spring are configured such that an urging force on the support member by the second spring is not imparted on the first spring, and wherein the driving member is configured to supply the drive force through the drive force transmitting path to the conveying roller.

2. The sheet conveying device according to claim 1, wherein the link maintains the movable member at a position where the drive force transmitting path is connected while a press portion provided on the accommodating tray presses the link, wherein the movable member and the link are mounted on the main body.

3. The sheet conveying device according to claim 1, wherein the drive force transmitting path includes a plurality of gears, and the movable member is at least one of the plurality of gears, wherein when the movable member moves to disengage with the other gears, the drive force transmitting path is disconnected.

4. The sheet conveying device according to claim 3, wherein the at least one of the plurality of gears is movable in an axial direction thereof.

5. The sheet conveying device according to claim 3, wherein the support member rotatably supports the movable member, and wherein the support member is movable relative to the other gears, and wherein the first spring is configured to exert, on the movable member, a first elastic force in an engaging direction toward a position at which the movable member engages with other gears.

6. The sheet conveying device according to claim 5, wherein the link has: a leading surface for leading the support member along the engaging direction by slidably contacting with a cam surface formed on the support member; and a maintaining surface for maintaining the support member at an engagable position at which the drive force transmitting path is connected.

7. The sheet conveying device according to claim 3, wherein the movable member has a sloping guide surface at which the movable member collides with the other gears when the movable member moves from a position at which the movable member is disengaged from the other gears toward a position at which the movable member is engaged with the other gears.

8. The sheet conveying device according to claim 5, wherein the second spring is configured to exert, on the support member, a second elastic force for urging the support member in a separating direction.

9. The sheet conveying device according to claim 1, wherein the accommodating tray includes a press roller that is disposed facing the conveying roller and that presses the sheet against the conveying roller, wherein the conveying roller is exposed outside the main body when the accommodating tray is detached from the main body.

10. The sheet conveying device according to claim 9, wherein a part of a sheet conveying path through which the sheet is conveyed by the conveying roller is exposed outside the main body when the accommodating tray is detached from the main body.

11. The sheet conveying device according to claim 1, wherein the movable member directly transmits the drive force to a drive shaft of the conveying roller.

12. The sheet conveying device according to claim 1, wherein the support member is configured to move between a first position where the movable member connects the drive force transmitting path and a second position where the movable member disconnects the drive force transmitting path.

13. An image forming device comprising:

an image forming unit configured to form an image on a sheet; and a sheet conveying device including:

a main body;

an accommodating tray having a sheet accommodating unit, wherein the accommodating tray is detachably mountable on the main body;

a conveying roller provided in the main body for conveying a sheet accommodated in the sheet accommodating unit;

a driving member provided in the main body and configured to supply a drive force to the conveying roller; and a clutch mechanism configured to disconnect a drive force transmitting path when the accommodating tray is detached from the main body and to connect the drive force transmitting path when the accommodating tray is attached to the main body, wherein the clutch mechanism includes:

a link configured to move in mechanical conjunction with the attachment and detachment of the accommodating tray to and from the main body, a movable member configured to move in association with movement of the link so as to selectively connect and disconnect the drive force transmitting path, and a support member configured to support the movable member and having a first spring, the first spring configured to urge the movable member in a first direction, wherein the sheet conveying device further comprises a second spring configured to urge the support member in a second direction opposite to the first direction, wherein the support member, the first spring and the second spring are configured such that an urging force on the support member by the second spring is not imparted on the first spring, and wherein the driving member is configured to supply the drive force through the drive force transmitting path to the conveying roller.

14. A sheet conveying device comprising:

a main body;

an accommodating tray having a sheet accommodating unit, wherein the accommodating tray is detachably mountable on the main body;

a conveying roller provided in the main body, the conveying roller configured to convey a sheet accommodated in the sheet accommodating unit;

a driving member provided in the main body and configured to supply a drive force to the conveying roller; and a clutch mechanism configured to disconnect a drive force transmitting path when the accommodating tray is detached from the main body and to connect the drive force transmitting path when the accommodating tray is attached to the main body, wherein the clutch mechanism includes:

a link configured to move in mechanical conjunction with the attachment and detachment of the accommodating tray to and from the main body, a movable member configured to move in association with the movement of the link so as to selectively connect and disconnect the drive force transmitting path, and a support member configured to support the movable member, wherein the link includes a first surface configured to contactably guide the support member in a direction in which the movable member connects the drive force transmitting path, and a second surface configured to maintain the support member in a position in which the movable member maintains a connection of the drive force transmitting path, and wherein the driving member is configured to supply the drive force through the drive force transmitting path to the conveying roller.

* * * * *